US009252499B2

(12) United States Patent
Chen et al.

(10) Patent No.: US 9,252,499 B2
(45) Date of Patent: Feb. 2, 2016

(54) ANTENNA UNIT

(75) Inventors: Ho-Chung Chen, Taipei (TW); James Wang, San Marino, CA (US)

(73) Assignee: MEDIATEK INC., Hsin-Chu (TW)

( * ) Notice: Subject to any disclaimer, the term of this patent is extended or adjusted under 35 U.S.C. 154(b) by 1142 days.

(21) Appl. No.: 12/977,353

(22) Filed: Dec. 23, 2010

(65) Prior Publication Data

US 2012/0162015 A1 Jun. 28, 2012

(51) Int. Cl.

| | |
|---|---|
| ***H01Q 1/38*** | (2006.01) |
| ***H01Q 13/12*** | (2006.01) |
| ***H01Q 1/42*** | (2006.01) |
| ***H01Q 13/00*** | (2006.01) |
| ***H01Q 21/06*** | (2006.01) |
| ***H01Q 9/04*** | (2006.01) |
| ***H01Q 19/00*** | (2006.01) |

(52) U.S. Cl.

CPC ..... *H01Q 21/065* (2013.01); *H01Q 9/0457* (2013.01); *H01Q 13/00* (2013.01); *H01Q 19/00* (2013.01); *H01Q 21/064* (2013.01)

(58) Field of Classification Search

CPC ..... H01Q 21/00; H01Q 13/18; H01Q 21/065; H01Q 13/106; H01Q 21/0031; H01Q 21/0062; H01Q 21/0075; H01Q 9/265; H01Q 9/0407; H01Q 9/0414; H01Q 9/0457; H01Q 9/0464; H01Q 1/38; H01Q 1/48; H01Q 7/00; H01Q 15/10; H01Q 21/10; H01Q 1/3233; H01L 24/49; G01S 13/48; H01P 7/06; H01P 7/10

USPC ..... 343/700 MS, 769, 789, 778

See application file for complete search history.

(56) References Cited

U.S. PATENT DOCUMENTS 3,665,480 A * 5/1972 Fassett ..... 343/754
4,197,544 A 4/1980 Kaloi (Continued)

FOREIGN PATENT DOCUMENTS

CN 1815806 8/2006
CN 101103491 1/2008

(Continued)

OTHER PUBLICATIONS

English language translation of abstract of JP 2001-177314 (published Jun. 29, 2001).

(Continued)

*Primary Examiner* — Graham Smith
(74) *Attorney, Agent, or Firm* — McClure, Qualey & Rodack, LLP

(57) ABSTRACT

An antenna unit is provided. The antenna unit includes a first substrate, a first conductive layer, a second conductive layer, a first planar conductive ring and a feed conductor. The first substrate includes a first surface and a second surface, wherein the first surface is opposite to the second surface. The first conductive layer is disposed on the first surface. The second conductive layer is disposed on the second surface, wherein a main opening surrounded by a plurality of first conductive vias electrically connecting the first and the second conductive surface is formed on the second conductive layer, and the main opening defines a radiation cavity and center frequency. The first planar conductive ring surrounds the radiation cavity. The feed conductor feeds a wireless signal to the antenna unit. Both the first planar conductive ring and the feed conductor are placed between the first conductor layer and the second conductor layer.

12 Claims, 11 Drawing Sheets

(56) References Cited

U.S. PATENT DOCUMENTS

| | | | | |
|---|---|---|---|---|
| 4,197,545 | A | 4/1980 | Favaloro et al. | |
| 4,792,809 | A | 12/1988 | Gilbert et al. | |
| 5,008,681 | A * | 4/1991 | Cavallaro et al. | 343/700 MS |
| 5,750,473 | A | 5/1998 | Shen | |
| 5,786,303 | A | 7/1998 | Mansour | |
| 6,034,637 | A | 3/2000 | McCoy et al. | |
| 7,369,088 | B2 | 5/2008 | Kushihi | |
| 7,429,952 | B2 | 9/2008 | Sun | |
| 7,623,073 | B2 | 11/2009 | Teshirogi et al. | |
| 7,808,439 | B2 | 10/2010 | Yang et al. | |
| 8,542,151 | B2 * | 9/2013 | Lin et al. | 343/700 MS |
| 2004/0056803 | A1 | 3/2004 | Soutiaguine et al. | |
| 2005/0068239 | A1 * | 3/2005 | Fischer et al. | 343/770 |
| 2006/0004419 | A1 | 1/2006 | Olbertz | |
| 2007/0052504 | A1 | 3/2007 | Fujita | |
| 2007/0080864 | A1 * | 4/2007 | Channabasappa | 343/700 MS |
| 2008/0068269 | A1 | 3/2008 | Yamada | |
| 2008/0191953 | A1 | 8/2008 | Bruno et al. | |
| 2010/0090903 | A1 * | 4/2010 | Byun et al. | 343/700 MS |
| 2010/0116675 | A1 | 5/2010 | Sklar et al. | |

FOREIGN PATENT DOCUMENTS

| | | |
|---|---|---|
| DE | 102006 041 994 | 4/2007 |
| DE | 102007 005 928 | 8/2007 |
| EP | 0 684 658 | 11/1995 |
| EP | 0 858 121 | 12/1998 |
| EP | 1 562 255 | 8/2005 |
| EP | 1 775 795 | 4/2007 |
| FR | 2 651 926 | 3/1991 |
| JP | A 1997-083232 | 3/1997 |
| JP | 2000-261235 | 9/2000 |
| JP | 2001-177314 | 6/2001 |
| JP | A 2004-07138 | 4/2004 |
| JP | A 2006-500821 | 5/2006 |
| JP | 2007-88883 | 4/2007 |
| JP | 2010-136296 | 6/2010 |
| WO | WO 02/15334 | 2/2002 |
| WO | WO 2004/027920 | 4/2004 |
| WO | WO 2005/117210 | 12/2005 |
| WO | WO 2006/079994 | 8/2006 |
| WO | WO 2008/069493 | 6/2008 |

OTHER PUBLICATIONS

English language translation of abstract of JP 2010-136296 (published Jun. 17, 2010).

English language translation of abstract of JP 2000-261235 (published Sep. 22, 2000).

English language translation of abstract of FR 2 651 926 (published Mar. 15, 1991).

English language translation of abstract of DE 10 2006 041 994 (published Apr. 5, 2007).

English language translation of abstract of DE 10 2007 005 928 (published Aug. 23, 2007).

Pozar, D.M., et al.; "Microstrip Antennas: The Analysis and Design of Microstrip Antennas and Arrays;" IEEE Press Marketing, table of contents; 1995; pp. 1-3.

Zwick, T., et al; "Broadband Planar Superstrate Antenna for Integrated Millimeterwave Transceivers;" IEEE Transactions on Antennas and Propagation; vol. 54, No. 10, Oct. 2006; pp. 2790-2796.

Van Beurden, M.C., et al.; "Analysis of Wide-Band Infinite Phased Arrays of Printed Folded Dipoles Embedded in Metallic Boxes;" IEEE Transactions on Antennas and Propagation, vol. 50, No. 9, Sep. 2002; pp. 1266-1273.

English language translation of abstract of JPA 1997-083232 (published Mar. 28, 1997).

English language translation of abstract of JP 2007-88883 (published Apr. 5, 2007).

* cited by examiner

ANTENNA UNIT

BACKGROUND OF THE INVENTION

1. Field of the Invention

The present invention relates to an antenna unit, and in particular relates to an antenna unit with improved isolation and beamwidth. The disclosed antenna unit is suitable for use in a phased-array antenna.

2. Description of the Related Art

FIG. 1 shows a conventional antenna 1, including an antenna substrate 10, a feed substrate 20, a microstrip patch 30, a ground plane 40 and a microstrip feed line 50. The antenna substrate 10 includes a first surface 11 and a second surface 12. The feed substrate 20 includes a third surface 21 and a fourth surface 22. The microstrip patch 30 is disposed on the first surface 11. The ground plane 40 is disposed on the third surface 21. The second surface 12 is connected to the ground plane 40. A coupling aperture 41 is formed on the ground plane 40. The microstrip feed line 50 is disposed on the fourth surface 22. The microstrip feed line 50 feeds wireless signals via the coupling aperture 41 to the microstrip patch 30. Conventional antennas typically have small bandwidths, undesirable back radiation and unwanted surface wave radiation issues. Additionally, when the conventional antennas are arranged in an array, isolation between the antennas is poor. c

BRIEF SUMMARY OF THE INVENTION

An antenna unit is provided. The antenna unit includes a first substrate, a first conductive layer, a second conductive layer, a first planar conductive ring and a feed conductor. The first substrate includes a first surface and a second surface, wherein the first surface is opposite to the second surface. The first conductive layer is disposed on the first surface. The second conductive layer is disposed on the second surface, wherein a main opening is formed on the second conductive layer surrounded by vias electrically connecting the first and the second conductive surfaces, and the main opening with the surrounding vias define a radiation cavity. The first planar conductive ring surrounds the radiation cavity. The feed conductor feeds a wireless signal to the antenna unit. Both the first planar conductive ring and the feed conductor are embedded in the first substrate.

The antenna unit of the embodiment of the invention provides improved isolation and stable active impedance for wide scanning angles. Additionally, in one embodiment, the feed conductor extends between the first conductive layer and the second conductive layer to feed the wireless signal to the antenna unit (lower feed structure). The proposed lower feed unit of the first embodiment therefore provides improved symmetrical gain patterns at both $\phi=0$ deg and $\phi=90$ deg directions.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
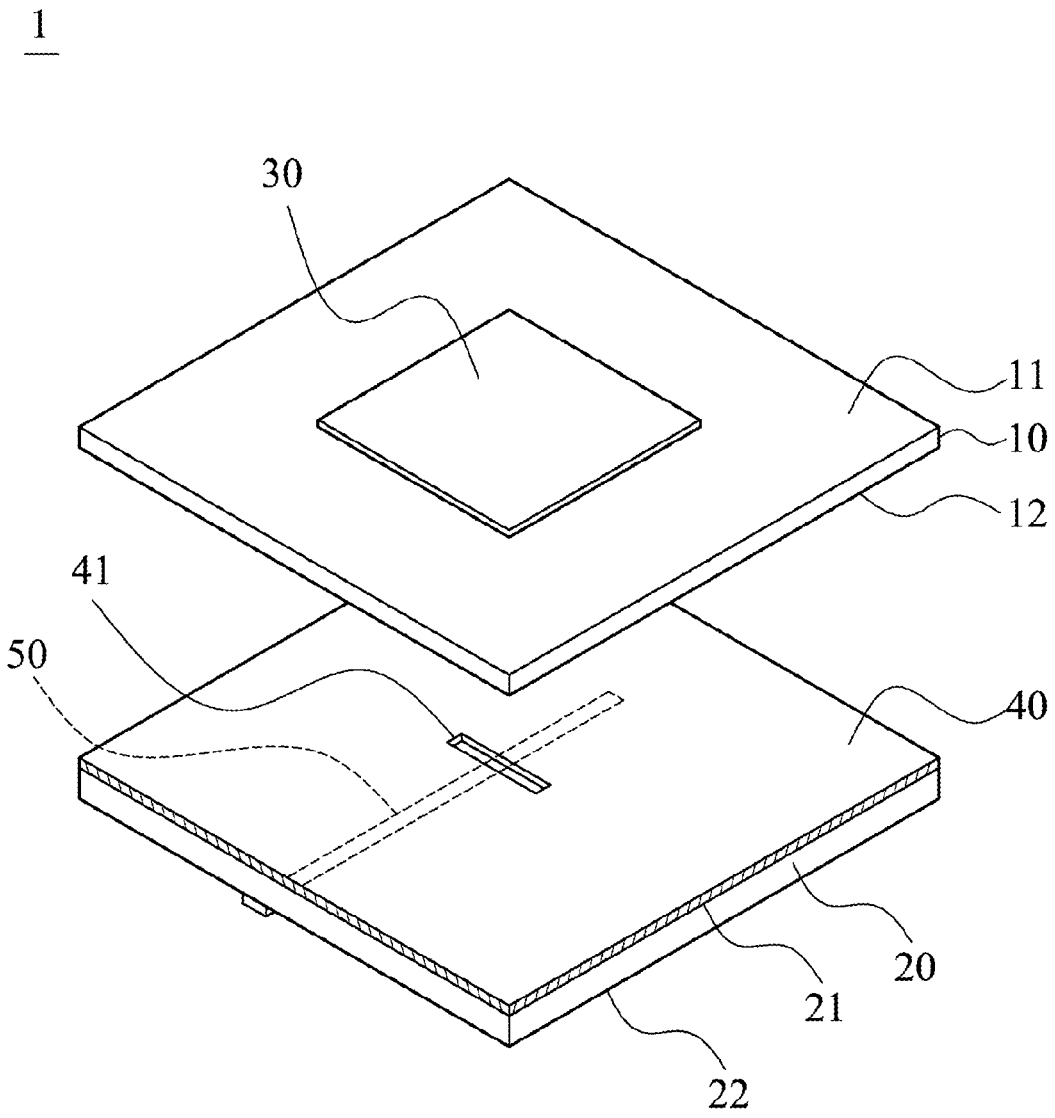
FIG. 1 shows a conventional antenna.
Figure 2:
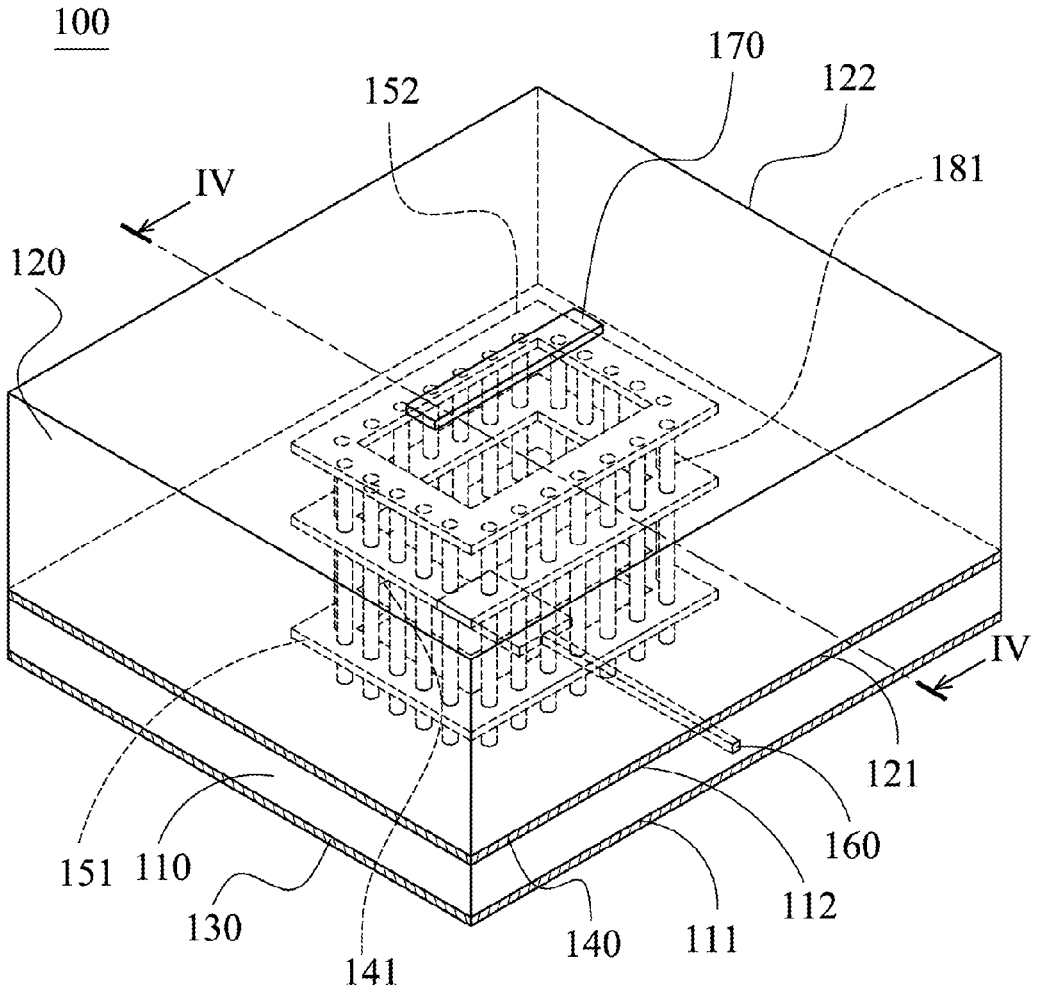
FIG. 2 shows an antenna unit of a first embodiment of the invention.

FIG. 2 shows an antenna unit 100 of a first embodiment of the invention. The antenna unit 100 includes a first substrate 110, a second substrate 120, a first conductive layer 130, a second conductive layer 140, zero or more planar conductive rings (planar conductive rings 151 and 152), a feed conductor 160, a patch 170, and a plurality of first conductive vias 181. The first substrate 110 includes a first surface 111 and a second surface 112, wherein the first surface 111 is opposite to the second surface 112. The second substrate 120 includes a third surface 121 and a fourth surface 122, wherein the third surface 121 is opposite to the fourth surface 122. The first conductive layer 130 is disposed on the first surface 111. The second conductive layer 140 is disposed on the second surface 112, wherein a main opening 141 is formed on the second conductive layer 140 surrounded by first conductive vias 181 electrically connecting the first conductive layer 130 and the second conductive layer 140, and the main opening 141 and the surrounding vias define a radiation cavity. The first planar conductive ring 151 is located between the first conductive layer 130 and the second conductive layer 140 (embedded in the first substrate 110). The second planar conductive rings 152 are above the first planar conductive ring 151 and embedded in the second substrate 120. The first planar conductive ring 151 and the second planar conductive rings 152 surround the radiation cavity. The first conductive vias 181 connect the first conductive layer 130, the second conductive layer 140, the first planar conductive ring 151 and the second planar conductive rings 152. The spacing of the first conductive vias 181 surrounding the radiation cavity satisfies a first predetermined rule. In this embodiment, the first conductive layer 130 and the second conductive layer 140 are ground layers, and therefore the surrounding vias 181, the first planar conductive ring 151, and the second planar conductive rings 152 are also grounded. The feed conductor 160 extends between the first conductive layer 130 and the second conductive layer 140 into the radiation cavity to feed a wireless signal to the antenna unit 100. The patch 170 is disposed on the fourth surface 122 above the main opening 141 and is separated from the feed conductor 160.

Figure 3:
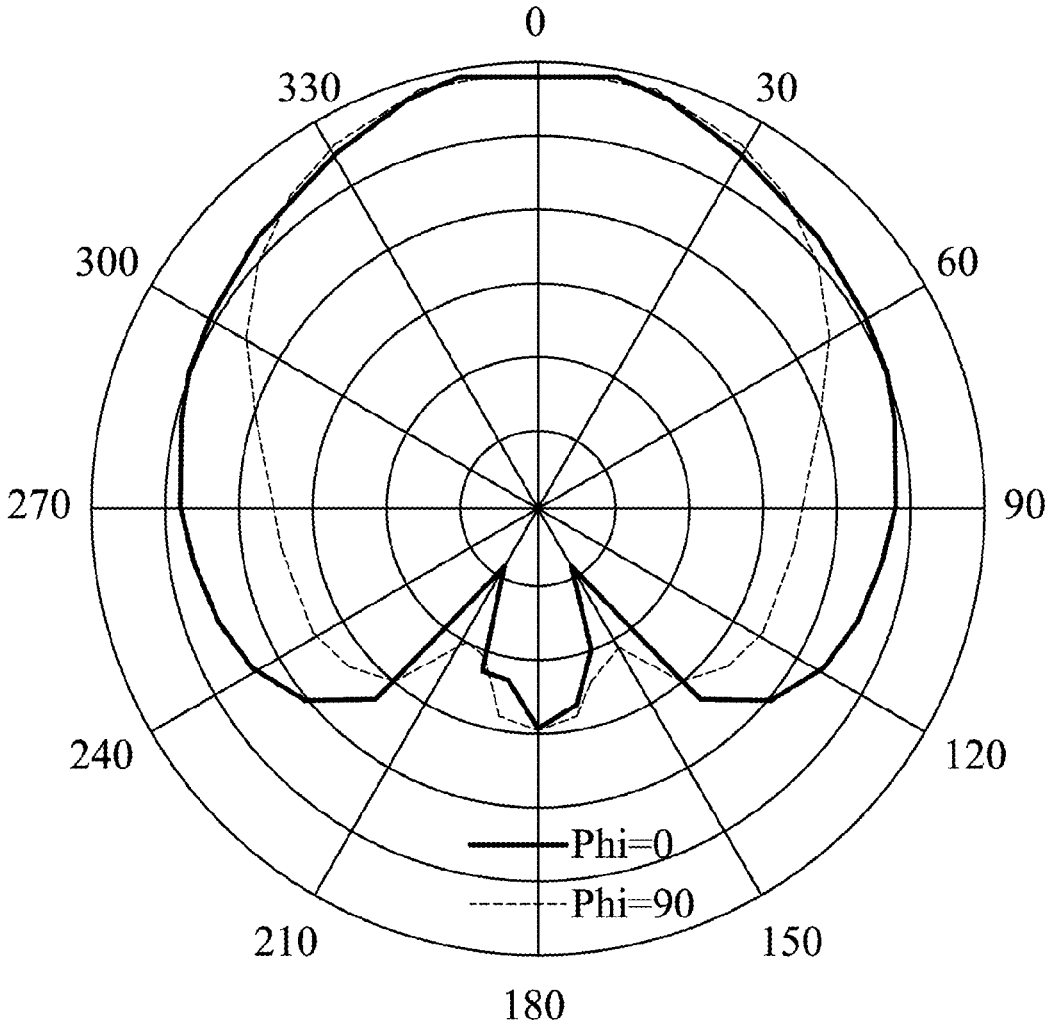
FIG. 3 shows E and H plane antenna patterns of the antenna unit of the first embodiment of the invention.

In the first embodiment, the second conductive layer 140 with the main opening 141, the first planar conductive ring 151, the second planar conductive rings 152, the first conductive vias 181 and the first conductive layer 130 form a cavity. Surface wave currents in first substrate 110 and second substrate 120 are impeded by the planar formed cavity. Therefore, the antenna unit 100 of the first embodiment provides improved isolation and stable active impedance for wide scanning angles. Additionally, the feed conductor 160 extends between the first conductive layer 130 and the second conductive layer 140 to feed the wireless signal to the antenna unit 100 (lower feed structure). The antenna unit 100 of the first embodiment therefore provides broad and improved symmetrical gain patterns at both $\phi$=0 deg and $\phi$=90 deg directions, as shown in FIG. 3.

Figure 4:
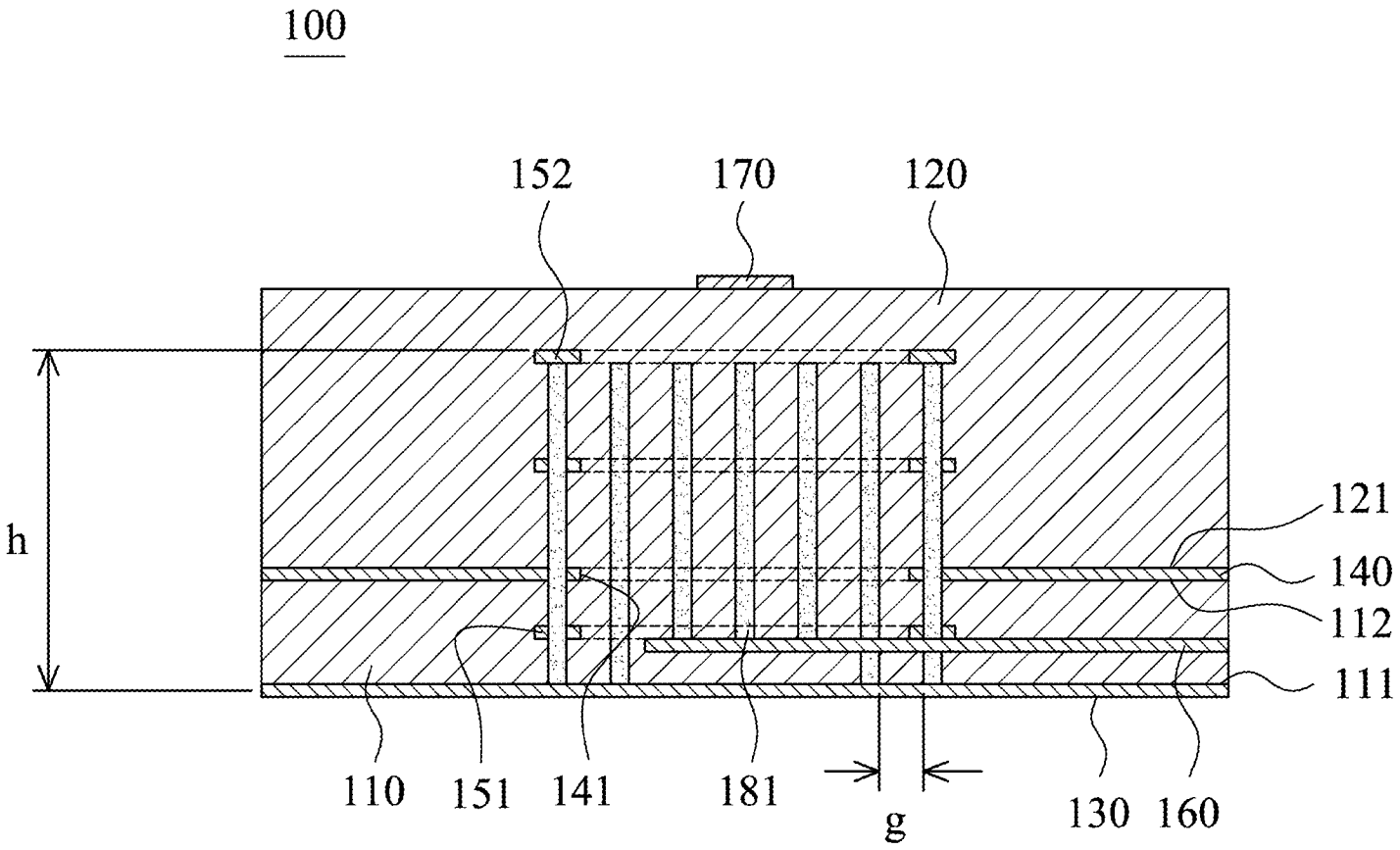
FIG. 4 is a sectional view along direction IV-IV of FIG. 2.

FIG. 4 is a sectional view along direction IV-IV of FIG. 2. The zero or more second planar conductive rings 152 are embedded in the second substrate 120. Although the zero or more second planar conductive rings 152 are separated from each other, they are connected to the first conductive vias 181. As shown in FIG. 4, the first conductive vias 181 extend through the first substrate 110 and the second substrate 120. The first planar conductive ring 151 is separated from the feed conductor 160. The first planar conductive ring 151 may be above or below the feed conductor 160, or located on a same plane with the feed conductor 160. When the first planar conductive ring 151 is located on a same plane with the feed conductor 160, the first planar conductive ring 151 includes a notch allowing the feed conductor 160 to pass therethrough. In the embodiment of FIG. 4, a height h between the first conductive layer 130 and the top layer of second conductive rings 152 is about 0.25$\lambda$. In an embodiment of the first predetermined rule, a gap g between each two adjacent conductive vias may be designed to be smaller than $\lambda/8$. The height h and gap g may also be modified.

Figure 5:
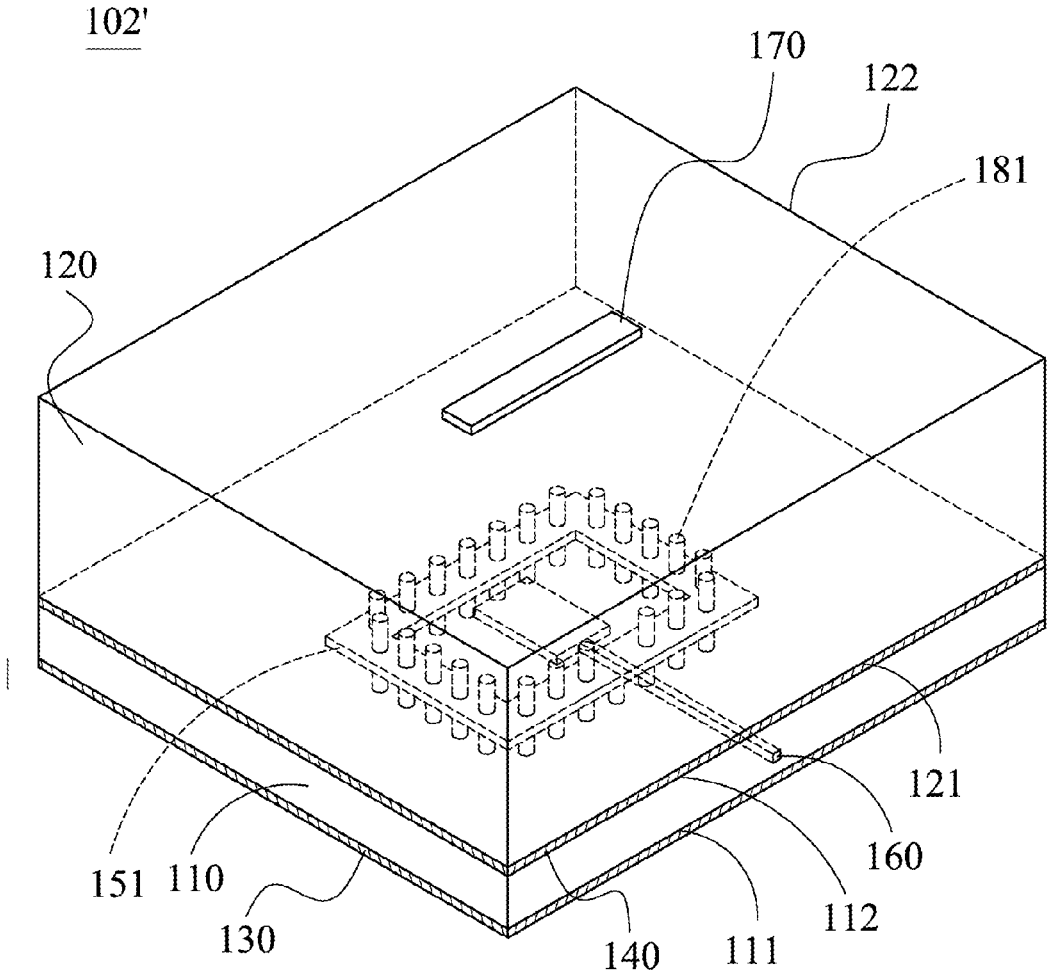
FIG. 5 shows an antenna unit of a second embodiment of the invention.

FIG. 5 shows an antenna unit 102' of a second embodiment of the invention, wherein the second planar conductive ring 152 is omitted. Compared to conventional art, the second embodiment of the invention also provides improved isolation.

Figure 6:
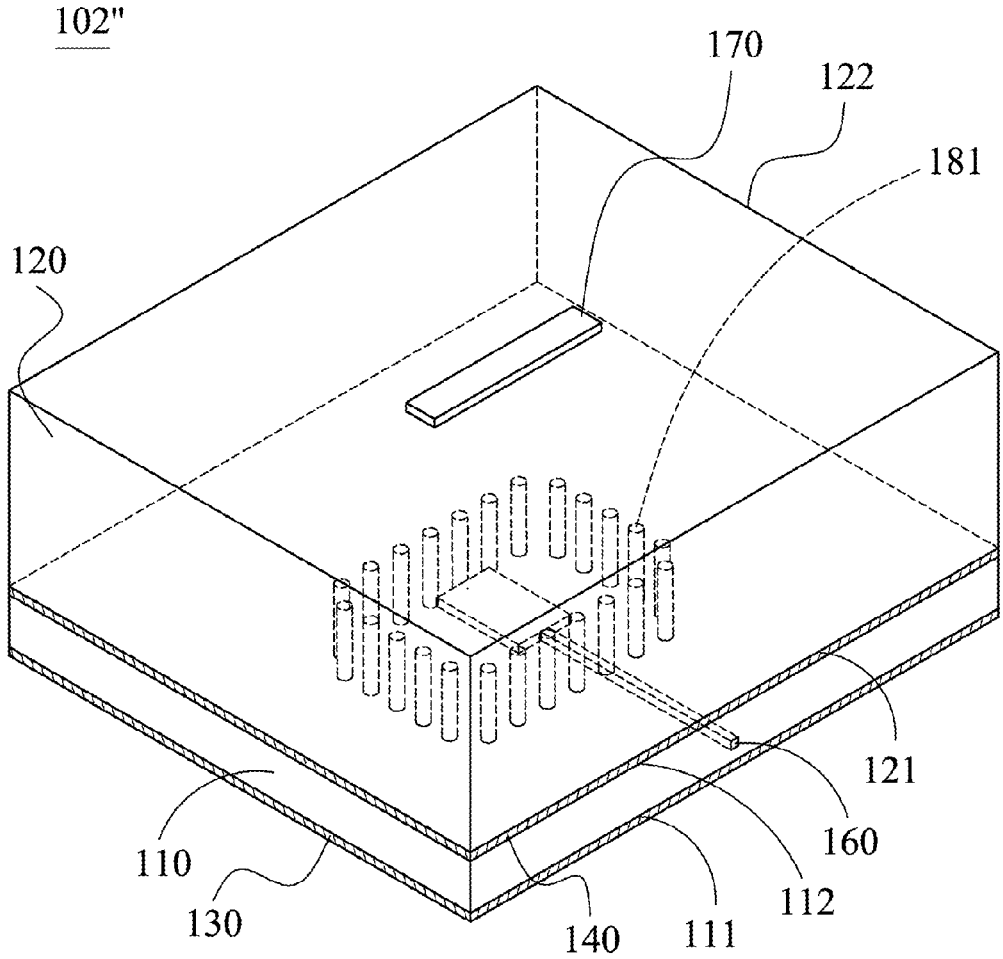
FIG. 6 shows an antenna unit of another modified example of the second embodiment.

FIG. 6 shows an antenna unit 102" of another modified example of the second embodiment. As shown in FIG. 6, the first planar conductive ring 151 may further be omitted. The antenna unit with the lower feed structure (the feed conductor 160 extends between the first conductive layer 130 and the second conductive layer 140) may also provide improved symmetrical gain patterns at both $\phi$=0 deg and $\phi$=90 deg directions.

Figure 7:
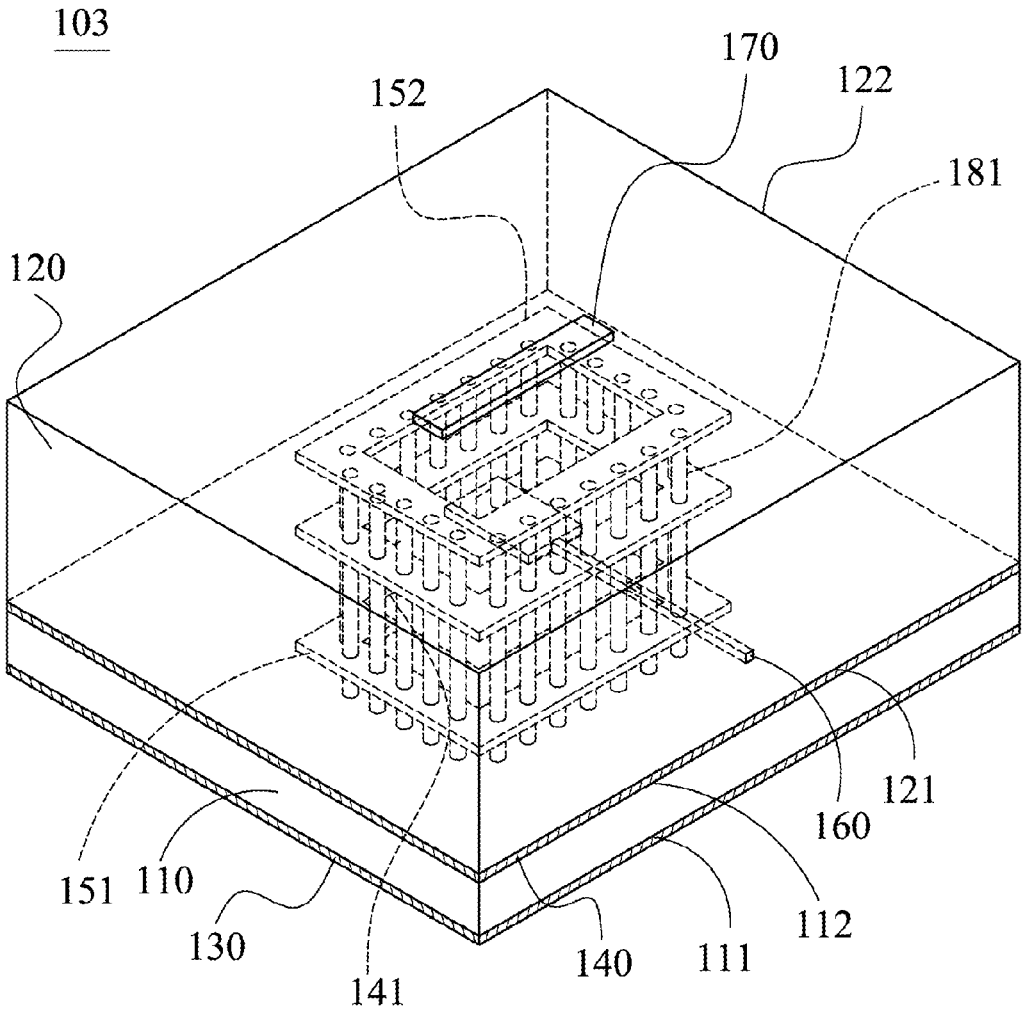
FIG. 7 shows an antenna unit of a third embodiment of the invention.

FIG. 7 shows an antenna unit 103 of a third embodiment of the invention, wherein the feed conductor 160 is being placed higher, above the second conductive layer 140. With the planar conductive rings of the antenna unit 103, the antenna unit 103 may still provide improved isolation and stable active impedance for wide scanning angles.

In the embodiments above, the first and second planar conductive rings may be planar metal rings, which are formed by printing. The first and the second substrates may be composed of a plurality of substrate layers.

Figure 8A:
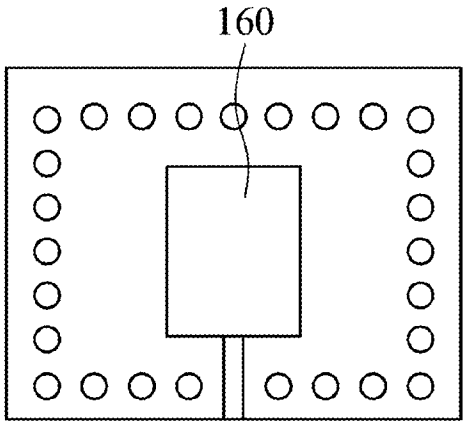
FIGS. 8A, 8B, 8C, 8D, 8E and 8F show modified examples of the invention.
Figure 8B:
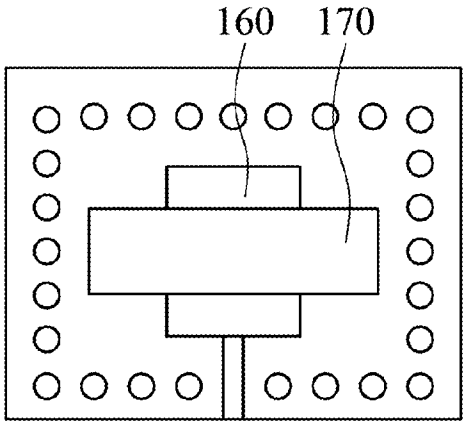
Figure 8C:
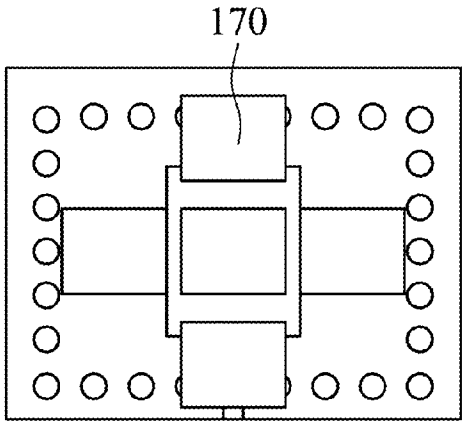
Figure 8D:
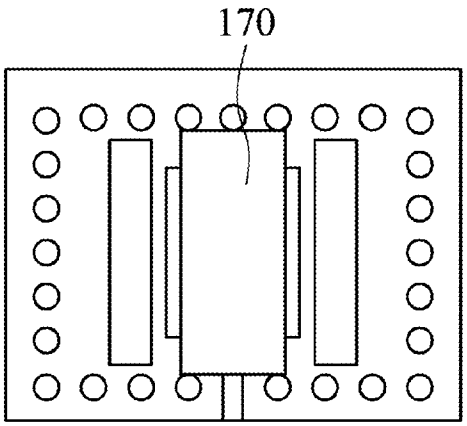
Figure 8E:
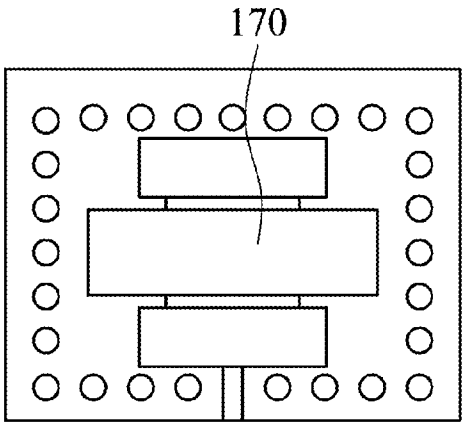
Figure 8F:
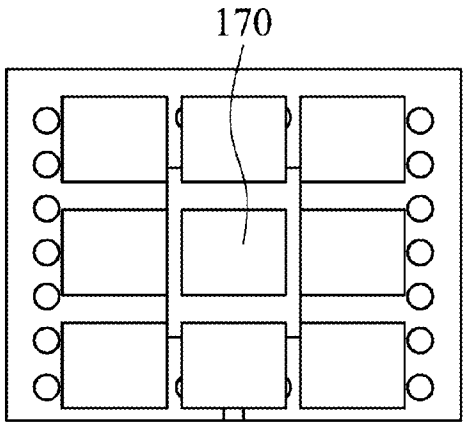

As shown in FIG. 8A, the patch may be omitted. FIGS. 8B-8F show modified examples of the invention, wherein the patch 170 may have different shapes, be arranged in different directions, or be arranged in an array.

Figure 9:
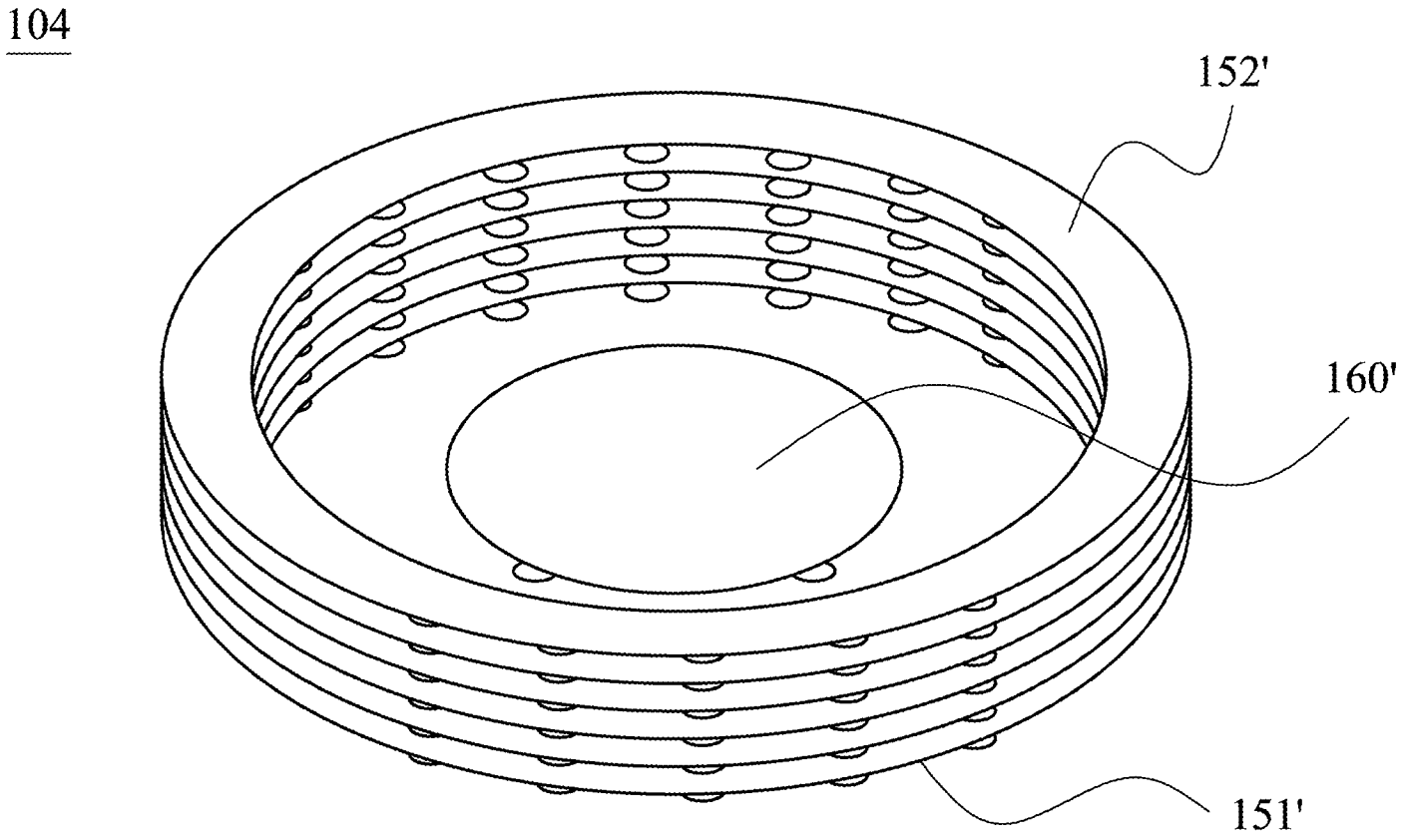
FIG. 9 shows an antenna unit of a fourth embodiment of the invention.

FIG. 9 shows an antenna unit 104 of a fourth embodiment of the invention, wherein the feed conductor 160', the first planar conductive ring 151' and the second planar conductive ring 152' are circular. As shown in the fourth embodiment, the shape of the feed conductor and the planar conductive rings may be modified.

Figure 10A:
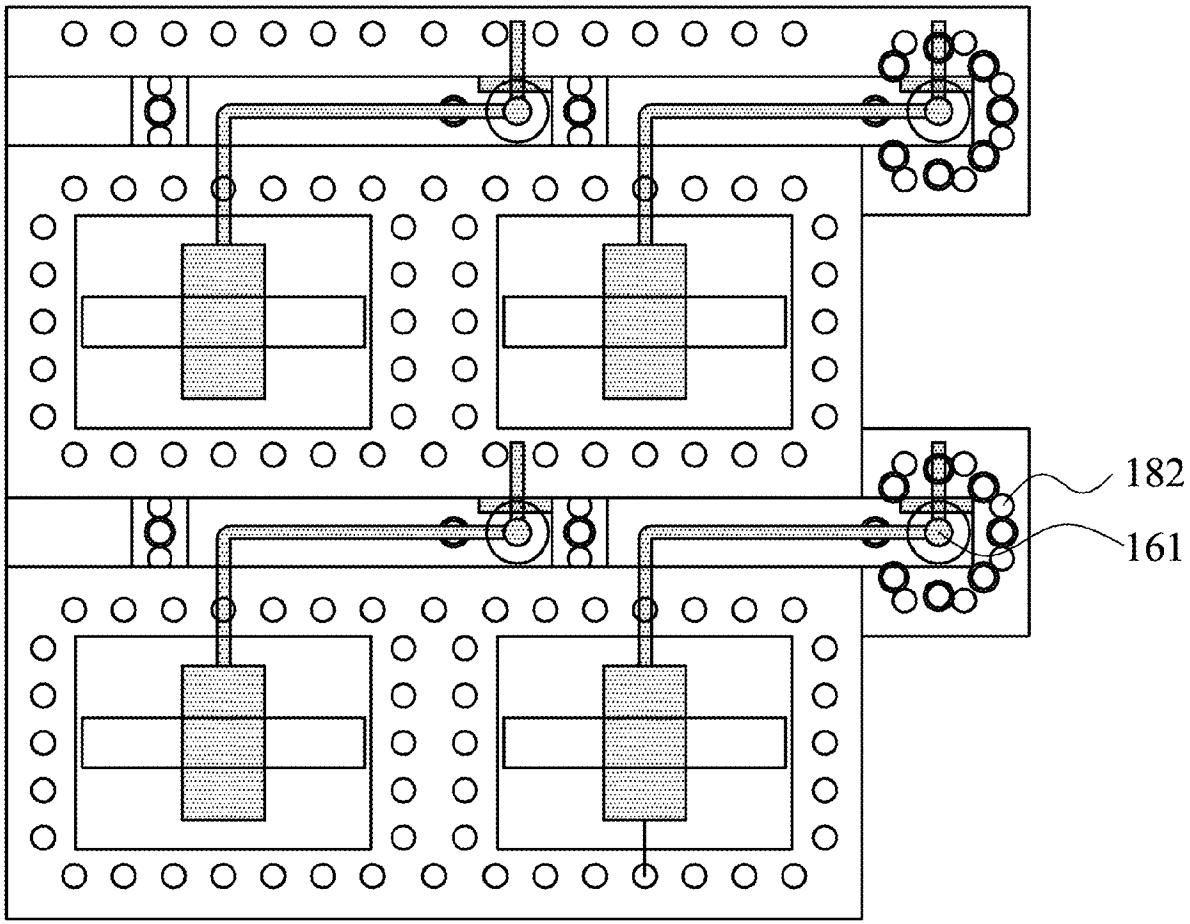
FIG. 10A shows a 2×2 antenna array of the invention, wherein the antenna units are integrated in the package design, which further comprises a plurality of second conductive vias and a vertical coaxial cable direct signals between different package layers.
Figure 10B:
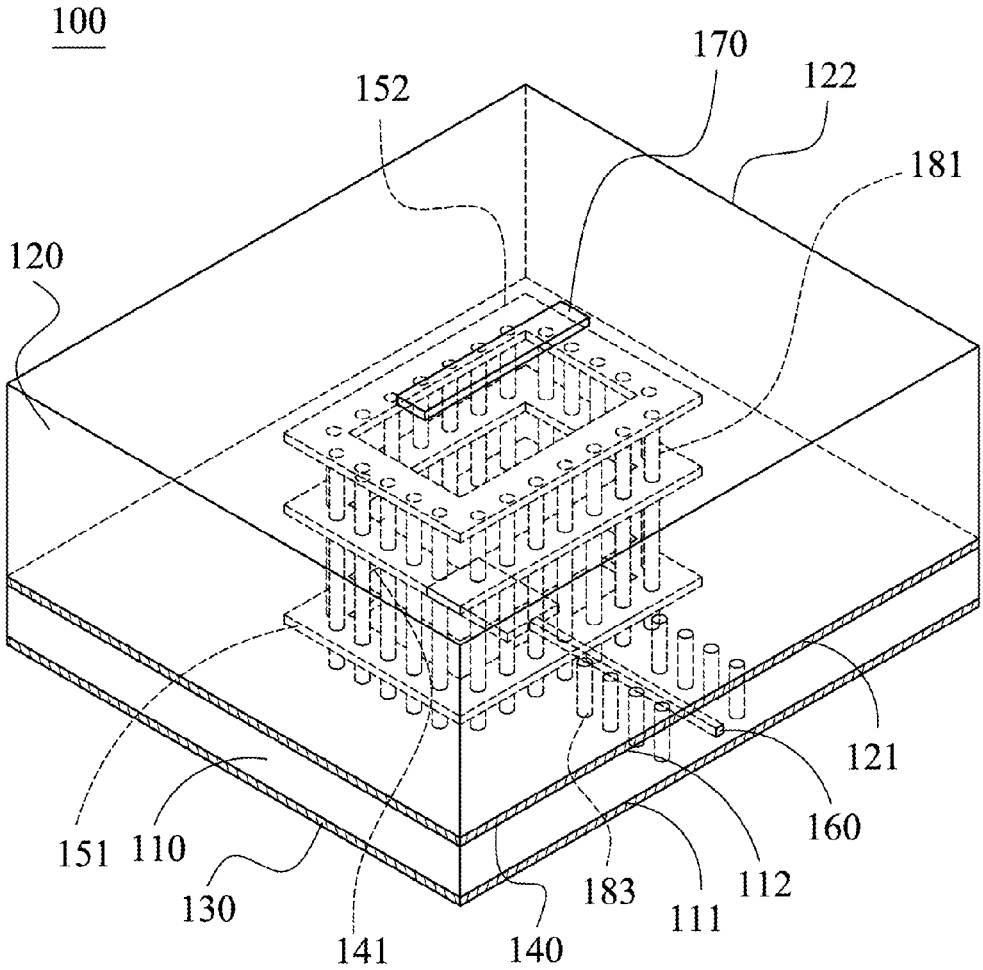
FIG. 10B shows another modified example, wherein the antenna unit further comprises a plurality of third conductive vias formed beside a feeding line of the feed conductor.

FIG. 10A shows a modified example of the invention consists of an antenna array embedded in a multiple layer package substrate with 2×2 antenna units 100, 102, 102', 102", 103, or 104, which further comprises a vertical coaxial cable formed by a plurality of second conductive vias 182 and a center conductor 161 to provide signal interconnection between different layers in the package substrate. The second conductive vias 182 connect between the first conductive layer 130 and the second conductive layer 140, surrounding at least a portion of the center conductor 161 of the coaxial cable. In an antenna array, the connection between the feed conductor 160 and coax cable is shortened and is surrounded by grounded vias to minimize transmission line loss and eliminate the unwanted coupling, wherein the unwanted coupling may come from not only the adjacent antenna elements but also the package power planes and other interconnection lines. As shown in FIG. 10B, in another modified example, a plurality of third conductive vias 183 may be formed beside the feed conductor 160. The second and third conductive vias 182 and 183 may provide lower feed line loss, and eliminate unwanted coupling which is coming from adjacent antenna element's feed conductor 160 or other signal lines in package layout. Both the FIGS. 10A and 10B embodiments of the invention can be easily mass produced by a standard low-cost PCB or LTCC process.

Note that use of ordinal terms such as "first", "second", "third", etc., in the claims to modify a claim element does not by itself connote any priority, precedence, or order of one claim element over another or the temporal order in which acts of the method are performed, but are used merely as labels to distinguish one claim element, having a certain name, from another element, having a same name (except for use of ordinal terms), to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna unit, comprising:

a first substrate, comprising a first surface and a second surface, wherein the first surface is opposite to the second surface;

a first conductive layer, disposed on the first surface; and a second conductive layer, disposed on the second surface, wherein the second conductive layer has a main opening which is surrounded by a plurality of first conductive vias electrically connecting the first and the second conductive surface, and the main opening and surrounding vias defines a radiation cavity;

a first planar conductive ring, surrounding the radiation cavity; and a feed conductor, feeding a wireless signal to the antenna unit;

wherein the feed conductor is located between the first conductive layer and the second conductive layer;

wherein the antenna unit further comprises a second substrate and a patch, the second substrate is disposed on the second conductive layer and comprises a third surface and a fourth surface, the third surface is opposite to the fourth surface, the patch is disposed on the fourth surface above the main opening and is separated from the feed conductor, and the third surface contacts the second conductive layer.

2. The antenna unit as claimed in claim 1, wherein zero or more first planar conductive ring is located between the first conductive layer and the second conductive layer.

3. The antenna unit as claimed in claim 1, wherein the first planar conductive ring is embedded in the first substrate.

4. The antenna unit as claimed in claim 3, wherein the first planar conductive ring is electrically connected to the first conductive vias.

5. The antenna unit as claimed in claim 1, further comprising zero or more second planar conductive ring, surrounding the radiation cavity, wherein the second planar conductive ring is embedded in the second substrate and above the first planar conductive ring.

6. The antenna unit as claimed in claim 1, further comprising zero or more second planar conductive ring, surrounding the radiation cavity, wherein the second planar conductive ring is disposed on the second substrate and above the first planar conductive ring.

7. The antenna unit as claimed in claim 5 or 6, wherein the second planar conductive ring and the first planar conductive ring are electrically connected to the first and second conductive layers.

8. The antenna unit as claimed in claim 1, wherein the feed conductor is embedded in the second substrate above the second conductive layer.

9. The antenna unit as claimed in claim 1, further comprising a plurality of second conductive vias and a via formed vertical coaxial cable, for isolating the antenna feed conductor from unwanted coupling and routing signals into other layers in package design.

10. The antenna unit as claimed in claim 1, wherein space between each two of the first adjacent conductive vias is smaller than $\lambda/8$, wherein $\lambda$ represents a free space wavelength relative to the antenna unit.

11. An antenna unit, comprising:

a first substrate, comprising a first surface and a second surface, wherein the first surface is opposite to the second surface;

a first conductive layer, disposed on the first surface; and a second conductive layer, disposed on the second surface, wherein the second conductive layer has a main opening which is surrounded by a plurality of first conductive vias electrically connecting the first and the second conductive surface, and the main opening and the surrounding vias define a radiation cavity;

a second substrate, wherein the second substrate is disposed on the second conductive layer and comprises a third surface and a fourth surface, the third surface is opposite to the fourth surface, and the third surface contacts the second conductive layer;

zero or more planar conductive ring, embedded in the second substrate and surrounding the radiation cavity; and a feed conductor, feeding a wireless signal to the antenna unit;

wherein the feed conductor is located between the first conductive layer and the second conductive layer;

wherein the antenna unit further comprises a patch, and the patch is disposed on the fourth surface above the main opening and is separated from the feed conductor.

12. The antenna unit as claimed in claim 11, wherein space between each two of the first adjacent conductive vias is smaller than $\lambda/8$, wherein $\lambda$ represents a free space wavelength relative to the antenna unit.

* * * * *